US007463225B2

(12) United States Patent
Ozawa

(10) Patent No.: US 7,463,225 B2
(45) Date of Patent: Dec. 9, 2008

(54) DEVICE AND METHOD FOR DRIVING ELECTRO-OPTICAL PANEL, ELECTRO-OPTICAL DEVICE, AND ELECTRONIC APPARATUS

(75) Inventor: Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 770 days.

(21) Appl. No.: 10/994,418

(22) Filed: Nov. 23, 2004

(65) Prior Publication Data

US 2005/0116916 A1 Jun. 2, 2005

(30) Foreign Application Priority Data

Dec. 1, 2003 (JP) ..... 2003-401532

(51) Int. Cl.
*G09G 3/30* (2006.01)

(52) U.S. Cl. ..... 345/76; 345/78; 345/89; 345/690; 345/698

(58) Field of Classification Search ..... 345/76–101, 345/204–215, 690–699
See application file for complete search history.

(56) References Cited

U.S. PATENT DOCUMENTS

| | | | | |
|---|---|---|---|---|
| 7,012,597 | B2 | 3/2006 | Kasai | |
| 7,038,645 | B2 * | 5/2006 | Ozawa et al. | 345/89 |
| 7,227,517 | B2 * | 6/2007 | Imamura | 345/76 |
| 2002/0003521 | A1 * | 1/2002 | Matsueda et al. | 345/89 |
| 2002/0018056 | A1 * | 2/2002 | Ozawa et al. | 345/204 |
| 2002/0060657 | A1 * | 5/2002 | Matsueda et al. | 345/89 |
| 2005/0127845 | A1 | 6/2005 | Kasai | |

FOREIGN PATENT DOCUMENTS

| | | |
|---|---|---|
| JP | A-10-198313 | 7/1998 |
| JP | A-2003-99001 | 4/2003 |
| JP | A-2003-150082 | 5/2003 |
| JP | A-2003-216100 | 7/2003 |
| JP | A-2003-233347 | 8/2003 |
| JP | A-2003-332910 | 11/2003 |
| JP | A 2005-157349 | 6/2005 |

* cited by examiner

*Primary Examiner*—Vijay Shankar
(74) *Attorney, Agent, or Firm*—Oliff & Berridge, PLC

(57) ABSTRACT

To increase a current value of a source line at the time of current programming. A device for driving an electro-optical panel in which a plurality of pixels each have an electro-optical element and active element means for selectively supplying electric charge to the electro-optical element through a source line in response to a write selection signal. The driving device comprises: first driving means for simultaneously supplying the write selection signal to k rows of pixel units including an n-th row of pixel units through a write scanning line in a first period of a horizontal scanning period for storing the electric charge in the n-th row of pixels, and for supplying the write selection signal to the n-th row of pixel units in a second period of the horizontal scanning period for storing electric charge; and a second driving means for simultaneously performing first electric charge supply on the k rows of pixel units arranged along any one of the source lines through the one source line in the first period, and for performing second electric charge supply on the n-th row of pixel units through the one source line in the second period.

10 Claims, 9 Drawing Sheets

FIG. 3

| | FIRST COLUMN | SECOND COLUMN | THIRD COLUMN |
|---|---|---|---|
| FIRST ROW | FIRST ROW PIXEL IS OFF | FIRST ROW PIXEL IS OFF | FIRST ROW PIXEL IS OFF |
| SECOND ROW | SECOND ROW PIXEL IS OFF | SECOND ROW PIXEL IS OFF | SECOND ROW PIXEL IS OFF |
| THIRD ROW | THIRD ROW PIXEL IS ON | THIRD ROW PIXEL IS ON | THIRD ROW PIXEL IS ON |
| FOURTH ROW | FOURTH ROW PIXEL IS ON | FOURTH ROW PIXEL IS ON | FOURTH ROW PIXEL IS ON |
| FIFTH ROW | FIFTH ROW PIXEL IS ON | FIFTH ROW PIXEL IS ON | FIFTH ROW PIXEL IS ON |
| SIXTH ROW | SIXTH ROW PIXEL DATA IS WRITTEN | SIXTH ROW PIXEL DATA IS WRITTEN | SIXTH ROW PIXEL DATA IS WRITTEN |
| SEVENTH ROW | SIXTH ROW PIXEL DATA IS WRITTEN | SIXTH ROW PIXEL DATA IS WRITTEN | SIXTH ROW PIXEL DATA IS WRITTEN |
| EIGHTH ROW | SIXTH ROW PIXEL DATA IS WRITTEN | SIXTH ROW PIXEL DATA IS WRITTEN | SIXTH ROW PIXEL DATA IS WRITTEN |
| NINTH ROW | NINTH ROW PIXEL IS OFF | NINTH ROW PIXEL IS OFF | NINTH ROW PIXEL IS OFF |
| TENTH ROW | TENTH ROW PIXEL IS OFF | TENTH ROW PIXEL IS OFF | TENTH ROW PIXEL IS OFF |

FIG. 4

| | FIRST COLUMN | SECOND COLUMN | THIRD COLUMN |
|---|---|---|---|
| FIRST ROW | FIRST ROW PIXEL IS OFF | FIRST ROW PIXEL IS OFF | FIRST ROW PIXEL IS OFF |
| SECOND ROW | SECOND ROW PIXEL IS OFF | SECOND ROW PIXEL IS OFF | SECOND ROW PIXEL IS OFF |
| THIRD ROW | THIRD ROW PIXEL IS OFF | THIRD ROW PIXEL IS OFF | THIRD ROW PIXEL IS OFF |
| FOURTH ROW | FOURTH ROW PIXEL IS ON | FOURTH ROW PIXEL IS ON | FOURTH ROW PIXEL IS ON |
| FIFTH ROW | FIFTH ROW PIXEL IS ON | FIFTH ROW PIXEL IS ON | FIFTH ROW PIXEL IS ON |
| SIXTH ROW | SIXTH ROW PIXEL IS ON | SIXTH ROW PIXEL IS ON | SIXTH ROW PIXEL IS ON |
| SEVENTH ROW | SEVENTH ROW PIXEL DATA IS WRITTEN | SEVENTH ROW PIXEL DATA IS WRITTEN | SEVENTH ROW PIXEL DATA IS WRITTEN |
| EIGHTH ROW | SEVENTH ROW PIXEL DATA IS WRITTEN | SEVENTH ROW PIXEL DATA IS WRITTEN | SEVENTH ROW PIXEL DATA IS WRITTEN |
| NINTH ROW | SEVENTH ROW PIXEL DATA IS WRITTEN | SEVENTH ROW PIXEL DATA IS WRITTEN | SEVENTH ROW PIXEL DATA IS WRITTEN |
| TENTH ROW | TENTH ROW PIXEL IS OFF | TENTH ROW PIXEL IS OFF | TENTH ROW PIXEL IS OFF |

DEVICE AND METHOD FOR DRIVING ELECTRO-OPTICAL PANEL, ELECTRO-OPTICAL DEVICE, AND ELECTRONIC APPARATUS

BACKGROUND

The present invention relates to a device and a method for driving an electro-optical panel, such as an organic EL (electro-luminescent) panel, an electro-optical device comprising the electro-optical panel and the driving device, such as an organic EL device, and a variety of electronic apparatuses having the electro-optical device.

In this type of electro-optical device, a plurality of pixel units each comprising active elements, a storage capacitor, and an electro-optical element driven according to electric charge stored into the storage capacitor is arranged in an image display region on a substrate, and a current program is executed to actively drive the plurality of pixel units. By executing the current program, flickers generated by the difference in threshold voltage between the active elements in the pixel units are suppressed, so that high-quality image display can be performed.

At the time of current programming, in each pixel unit, a current that corresponds to a gray scale level to be displayed in the pixel unit is supplied through a source line to the storage capacitor, and the electric charge is stored according to the supplied current. Here, when the current value of the source line is low, a parasitic capacitor of the source line as well as the storage capacitor should be charged with a low current. For this reason, it is difficult to store a predetermined electric charge in each pixel unit for a short time.

Therefore, in order to increase the current value of the source line at the time of current programming, current mirrors comprising thin film transistors (hereinafter, referred to as "TFTs") are provided to the respective pixel units as described in Patent Document 1 described below. Alternatively, pixel units in a plurality of rows arranged along the source lines are selected according to Patent Documents 2 and 3. In particular, according to Patent Document 2, a current ten times as large as the current supplied to one pixel unit is provided to the source line in response to selected k rows of pixel units (where, k is a natural number greater than or equal to 2).

[Patent Document 1] Japanese Unexamined Patent Application Publication No. 2003-99001.

[Patent Document 2] Japanese Unexamined Patent Application Publication No. 2003-150082.

[Patent Document 3] Japanese Unexamined Patent Application Publication No. 10-198313.

SUMMARY

However, according to Patent Document 1, since the circuit size of each pixel unit becomes large, an aperture ratio in the image display region is reduced, and the current density is increased, thereby deteriorating the reliability of the electro-optical element. Furthermore, at the time of the operation of the electro-optical element, as the TFTs constituting the current mirror is turned off, a field-through occurs in the storage capacitor, so that the amount of electric charge stored in the storage capacitor is changed, which results in poor reproducibility of the gray scale level for each pixel unit.

In addition, according to Patent Document 2, at the time of current programming, a current averaging the currents provided to the source line is supplied to the selected pixel units. As a result, if there is a defect in some of the pixels units, e.g., the active elements, among the selected pixel units, the defect will affect all the selected pixel units. Therefore, even when the current program is executed, a satisfactory image display in the image display region is often not obtained.

Accordingly, the present invention is designed to solve the above-mentioned problems, and it is an object of the present invention to provide a device and a method for driving an electro-optical panel capable of performing high-quality image display, an electro-optical device having the driving device, and various electronic apparatuses having the electro-optical device.

In order to achieve the above-mentioned object, according to an aspect of the present invention, there is provided a device for driving an active matrix electro-optical panel in which a plurality of pixels in an image display region each have an electro-optical element and active element means for actively controlling the electro-optical element to selectively supply electric charge to the electro-optical element through a source line in response to a write selection signal that selects a horizontal scanning period for storing the electric charge in each row of pixel units. The driving device comprises: first driving means for, in a first period of the horizontal scanning period for storing the electric charge in an n-th row of pixel units (where, n is a natural number), simultaneously supplying the write selection signal to k rows of pixel units (where, k is a natural number greater than or equal to 2) including the n-th row of pixel units through write scanning lines arranged to correspond to the respective rows of the pixel units, and for supplying the write selection signal to the n-th row of pixel units in a second period of the horizontal scanning period for storing the electric charge; and second driving means for simultaneously performing first electric charge supply on the k rows of pixel units arranged along any one of the source lines through the one source line in the first period, and for performing second electric charge supply on the n-th row of pixel units through the one source line in the second period.

According to the device for driving the electro-optical panel of the present invention, a predetermined voltage is programmed into the n-th row of pixel units arranged along any one of the source lines in the horizontal scanning period for strong electric charge as follows.

In the first period of the first and second periods of the horizontal scanning period for storing electric charge, the k rows of pixel units including the n-th row of pixel units are selected, and in the second period, the n-th row of pixel units is selected in response to the write selection signal supplied to the corresponding write scanning line by the first driving means.

In the first period, the second driving means performs first electric charge supply in which the amount of electric charges k times larger than that to be supplied to the n-th row of pixel units is supplied to the selected k rows of pixel units through the one source line. In addition, the amount of electric charges obtained by averaging the amount of electric charges supplied to the k rows of pixel units through the one source line is supplied to the k rows of the pixel units and are stored in each pixel unit by the active element means comprising the TFTs and the like.

In the second period, the second driving means performs second electric charge supply in which the amount of electric charges to be supplied to the n-th row of pixel units is supplied to the selected n-th row of pixel unit through the one source line. Here, the voltage corresponding to the stored electric charge is programmed into the n-th row of pixel units in the first period. The voltage is approximate to the predetermined voltage. In the second period, the electric charge is stored from the one source line to the n-th row of pixel units by the active element means, so that the predetermined voltage is programmed into the n-th row of pixel units.

Therefore, according to the driving device of the electro-optical panel of the present invention, it is possible to program the predetermined voltage into the n-th row of pixel units in a shorter time, compared to a case in which the electric charge is supplied by selecting only the n-th row of pixel units in the horizontal scanning period for storing electric charge. In particular, when the wiring capacitance of the source line is large enough not to be negligible, the source line is charged with k times the amount of electric charge in the first period, as described above. Therefore, in the second period, the electric charge can be stored in each pixel unit in a short time through the source line. Further, in the second period next to the first period, the predetermined voltage is programmed into the n-th row of pixel units. Therefore, even when defects are generated in any one of the k rows of pixel units, the programming for the n-th row of pixel units can be performed almost without being affected by the detects.

Furthermore, it is possible to increase a current value of the source line at the time of current programming without increasing the circuit size of each pixel unit. In addition, by performing such a current program, flickers can be prevented, thereby achieving a high-quality image display.

According to an aspect of the present invention, in the device for driving the electro-optical panel, after the second period, the active element means supplies the electric charge to the electro-optical element belonging to the n-th row of pixel units according to the second electric charge supply in response to a display selection signal that selects the horizontal scanning period for displaying each row of pixel units. Further, after the second period, the first driving means supplies the display selection signal to the n-th row of pixel units through a selection scanning line arranged correspond to each row of pixel units. In addition, the second driving means performs pseudo data signal supply as the first electric charge supply in the first period and performs the data signal supply on the n-th row of pixel units as the second electric charge supply in the second period.

According to the above aspect, in the first period of the horizontal scanning period for storing electric charge in the n-th row of pixel units, the pseudo data signal is applied from each source line to the k rows of pixel units, and in the second period, the data signal is applied from the one source line to the n-th row of pixel units. Therefore, in the first period, the voltage corresponding to the applied pseudo data signal is programmed into the n-th row of pixel units, and in the second period, the predetermined voltage is programmed in respond to the applied data signal.

Furthermore, after the second period, the first driving means provides the display selection signal to the n-th row of pixel units through the selection scanning line. In the n-th row of pixel units, it is possible for the active element means to drive the electro-optical element in response to the display selection signal correspondingly to the predetermined voltage by providing the electric charge corresponding to the data signal to the electro-optical element.

Further, in the above aspect in which the electric charge is supplied to the electro-optical element belonging to the n-th row of pixel units according to the second electric charge supply after the second period, after the horizontal scanning period for storing electric charge in the k rows of pixel units is over, the first driving means may provide the display selection signal for selecting the horizontal scanning period for display to the n-th row of pixel units included in the k rows of pixel units.

With this arrangement, it is possible to prevent the n-th row of pixel units from performing display in response to the pseudo data signal.

Furthermore, in the above-mentioned aspect in which the electric charge is supplied to the electro-optical element belong to the n-th row of pixel units according to the second electric charge supply after the second period, the active element means comprises: one or more first active elements for starting the first and second electric charge supplies in response to the write selection signal; and one or more second active elements for supplying the electric charge to the electro-optical elements belonging to the n-th row of pixel units according to the second electric charge supply in response to the display selection signal.

With this arrangement, active control with the active control means can be performed as described below.

In the first period of the horizontal scanning period for electric charge storage, the first active element controls the storage of the pseudo data signal in the k rows of pixel units, and the first active element controls the storage of the data signal in the n-th row of pixel units in the second period. Furthermore, in the horizontal scanning period for display, the second active element controls the driving of the electro-optical element.

According to another aspect of the present invention, in the device for driving the electro-optical panel, the plurality of pixel units each further comprise a storage capacitor for storing the electric charge supplied by the second charge supply so as to define the amount of electric charge applied to the electro-optical element through some of the active element means. Here, in the first and second periods, the second driving means performs the first and second electric charge supplies on the source lines and the storage capacitors, respectively.

With this arrangement, in the first period of the horizontal scanning period for storing electric charge, a voltage corresponding to the electric charge supplied from each source line is written to the storage capacitor in the k rows of pixel units. In the second period, a voltage corresponding to the second charge supply is written to the storage capacitor in the n-th row of pixel units. Therefore, it is possible to program a predetermined voltage into the storage capacitor by writing the voltage corresponding the electric charge supplied from the one source line to the storage capacitor in the n-th row of pixel units. Further, when the electro-optical element is driven by executing such a program, it is possible to perform display at a predetermined gray scale level in the n-th row of pixel units.

Moreover, according to the above-mentioned aspect in which the plurality of pixel units each further comprise the storage capacitor, in the second period, the second driving means may perform the second electric charge supply on the source lines and the storage capacitors to write a voltage corresponding to the data signal with respect to the n-th row of pixel units to the storage capacitor.

With this arrangement, it is possible to drive the electro-optical element according the predetermined voltage in response to the data signal in the n-th row of pixel units.

According to still another aspect of the electro-optical panel driving device of the present invention, the k rows of pixel units may comprise the n-th row of pixel units, an (n+1)-th row of pixel units, and an (n+2)-th row of pixel units.

With this arrangement, by reducing a duty ratio, it is possible to obtain a driving current of the electro-optical panel.

To solve the above-mentioned problems, the electro-optical device of the present invention comprises the device for driving the electro-optical panel (including various aspects) and the electro-optical panel according to the present invention.

According to the electro-optical device of the present invention, it is possible to prevent the generation of a flicker and thus to perform high-quality image display.

To solve the above-mentioned problems, an electronic apparatus of the present invention comprises the electro-optical device according to the above aspects.

Since the electronic apparatus of the present invention comprises the electro-optical device according to the present invention as described above, a variety of electronic apparatuses capable of performing the high-quality image display, such as a projection type display apparatus, a TV set, a mobile phone, an electronic organizer, a word processor, a viewfinder type or monitor-direct-view type videotape recorder, a work station, a television phone, a POS terminal, a touch panel, and the like can be realized. In addition, an electrophoresis device, such as an electronic paper, a field emission display, and a conduction electro-emitter display can be implemented, for example, as an electronic apparatus of the present invention.

To settle the above-mentioned problems, the prevent invention provides a method of driving an active matrix type electro-optical panel in which a plurality of pixels in an image display region each have an electro-optical element and active element means for actively controlling the electro-optical element to selectively supply electric charge to the electro-optical element through a source line in response to a write selection signal that selects a horizontal scanning period for storing the electric charge in each row of pixel units. The method comprises: a first driving step of, in a first period of the horizontal scanning period for storing the electric charge in an n-th row of pixel units (where, n is a natural number), simultaneously supplying the write selection signal to k rows of pixel units (where, k is a natural number greater than or equal to 2) including the n-th row of pixel units through write scanning lines arranged to correspond to the respective rows of the pixel units, and of supplying the write selection signal to the n-th row of pixel units in a second period of the horizontal scanning period for storing the electric charge; and a second driving step of simultaneously performing first electric charge supply on the k rows of pixel units arranged along any one of the source lines through the one source line in the first period, and of performing second electric charge supply on the n-th row of pixel units through the one source line in the second period.

According to the method for driving the electro-optical panel of the present invention, as in the device for driving the electro-optical panel of the present invention as described above, it is possible to program a predetermined voltage into the n-th row of pixel units in a shorter time, compared to a case in which the electric charge is supplied by selecting only the n-th row of pixel units in the horizontal scanning period for storing electric charge. Further, in the second period next to the first period, the predetermined voltage is programmed into the n-th row of pixel units. Therefore, even when defects are generated in any one of the k rows of pixel units, the programming of the n-th row of pixel units can be performed almost without being affected by the detects.

Furthermore, it is possible to increase a current value of the source line at the time of current programming, without increasing the circuit size of each pixel unit. In addition, by performing such a current program, flickers can be prevented, thereby achieving a high-quality image display.

These and other operations and benefits of the present invention will be apparent to those skilled in the art by reading embodiments of the present invention as described below.

BRIEF DESCRIPTION OF THE DRAWINGS

FIG. 3 is a schematic diagram for illustrating a first operation of the electro-optical device;

FIG. 4 is a schematic diagram for illustrating a second operation of the electro-optical device;

DETAILED DESCRIPTION OF EMBODIMENTS

An embodiment of the present invention will now be described with reference to the accompanying drawings.

<1: Configuration of Electro-Optical Device>

Figure 1:
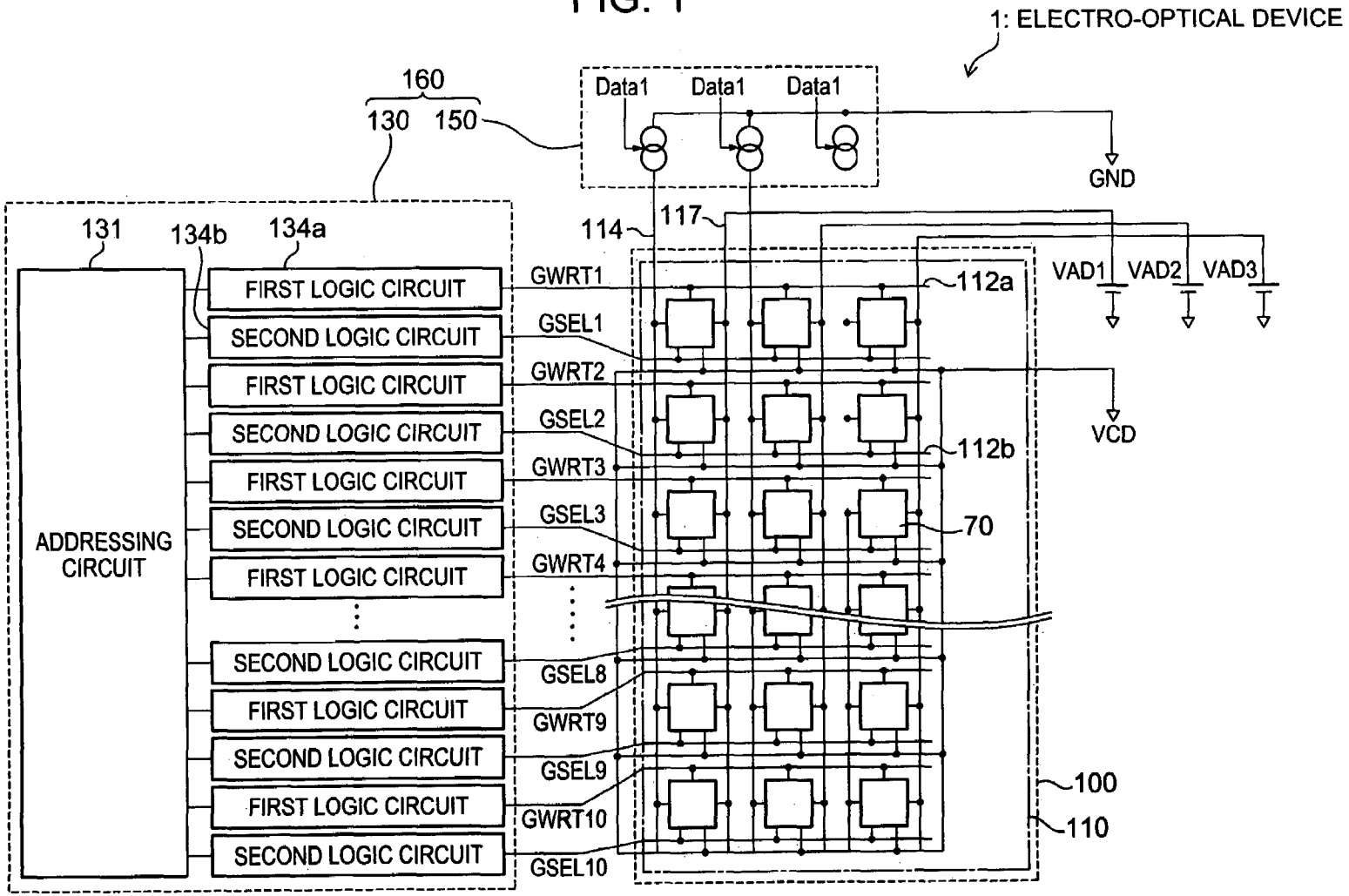
FIG. 1 is a block diagram showing the overall configuration of an electro-optical device.

First, the overall configuration of an electro-optical device according to the present invention will be described with reference to FIG. 1. FIG. 1 is a block diagram showing the overall configuration of the electro-optical device according to an embodiment of the present invention.

As shown in FIG. 1, a main unit of an electro-optical device 1 comprises an organic EL panel 100, which is an example of an "electro-optical panel" according to the present invention, and a driving device 160 including a scanning line driving circuit 130 that corresponds to "first driving means" according to the present invention and a data line driving circuit 150 that corresponds to "second driving means" according to the present invention.

The organic EL panel 100 comprises a plurality of source lines 114 and a plurality of write scanning lines 112*a*, that is, data lines arranged vertically and horizontally in an image display region 110, and each pixel unit 70 is arranged in a matrix so as to correspond to the intersections therebetween. In addition, in the image display region 110, selection scanning lines 112*b* are provided so as to correspond to the pixel units 70 arranged for the respective write scanning lines 112*a*, and power supply lines 117 are provided so as to correspond to the pixel units 70 arranged for the respective source lines 114.

According to an aspect of the present invention, it is assumed that a total number of the write scanning lines 112*a* is 10, and that a total number of the source lines 114 is 3 for the sake of the convenience of explanation. In addition, it is assumed that three types of source lines 114, that is, source lines for red (R), source lines for green (G), and source lines for blue (B) are provided.

Figure 2:
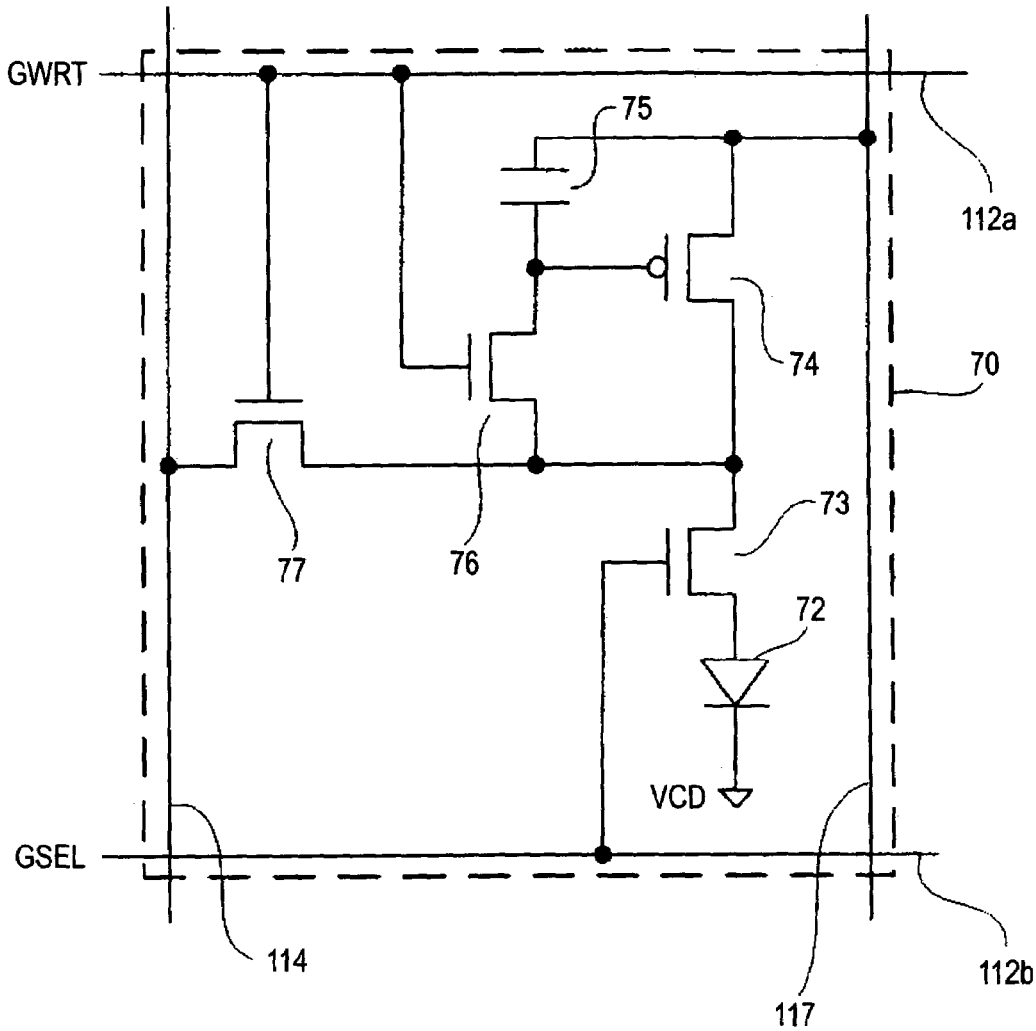
FIG. 2 is a circuit diagram showing a circuit configuration of a pixel unit.

FIG. 2 is a circuit diagram showing a circuit configuration of the pixel unit 70. In FIG. 2, the pixel unit 70 comprises four types of transistors, i.e., a switching transistor 77 that corresponds to a "first active element" according to the present invention, a programming transistor 76, a driving transistor 74, and a lighting transistor 73 that corresponds to a "second active element" according to the present invention; a storage capacitor 75; and an organic EL element 72 that corresponds to an "electro-optical element" according to the present invention.

"Active element means" according to the present invention is composed of these four types of transistors. Among these four types of transistors, the switching transistor 77, the programming transistor 76, and the lighting transistor 73 are composed of n-channel metal-oxide-semiconductor (MOS) TFTs, respectively, and the driving transistor 74 is composed of a p-channel MOSTFT. However, the switching transistor 77, the programming transistor 76, and the lighting transistor 73 may be composed of p-channel MOSTFTs, respectively, and the driving transistor 74 may be composed of an n-channel MOSTFT.

A gate electrode of each of the switching transistor 77 and the programming transistor 76 is electrically connected to the write scanning line 112*a*. A source electrode of the switching transistor 77 is electrically connected to the source line 114, and a drain electrode of the switching transistor 77 is electrically connected to a source electrode of the programming transistor 76 and a drain electrode of the driving transistor 74, respectively. In addition, a drain electrode of the programming transistor 76 is electrically connected to the storage capacitor 75. Further, a source electrode of the driving transistor 74 is electrically connected to a current supply line 117, and a gate electrode of the driving transistor 74 is electrically connected to a connecting point between the drain electrode of the programming transistor 76 and the storage capacitor 75. In addition, a source electrode of the lighting transistor 73 is electrically connected to the drain electrode of the driving transistor 74, and a drain electrode of the lighting transistor 73 is electrically connected an anode of the organic EL element 72. Furthermore, a gate electrode of the lighting transistor 73 is electrically connected to the selection scanning line 112*b*.

In FIG. 1, the electro-optical device 1 comprises a negative power source VCD and three types of positive power sources VAD1, VAD2, and VAD3. A cathode of the organic EL element 72 of each pixel unit 70 arranged in the image display region 110 is connected to the common negative power source VCD. Further, the power supply line 117 corresponding to the pixel unit 70 arranged along the source line 114 for R is connected to the positive power source VAD1 for R, and the power supply line 117 corresponding to the pixel unit 70 arranged along the source line 114 for G is connected to the positive power source VAD2 for G. In addition, the power supply line 117 corresponding to the pixel unit 70 arranged along the source line 114 for B is connected to the positive power source VAD3 for B.

The scanning line driving circuit 130 comprises an addressing circuit 131, first logic circuits 134*a* each connected to the corresponding write scanning line 112*a*, and second logic circuits 134*b* each connected to the corresponding selection scanning line 112*b*. In the scanning line driving circuit 130, the first logic circuit 134*a* generates a write selection signal GWRT based on the signal output from the addressing circuit 131, and the second logic circuit 134*b* generates a display selection signal GSEL based on the signal output from the addressing circuit 131.

The write selection signal GWRT is output to the write scanning line 112*a* that corresponds to the first logic circuit 134*a* at a predetermined timing. The write selection signal GWRT is a signal for selecting a horizontal scanning period for storing electric charge in a pixel row corresponding to the write scanning line 112*a*. In addition, the display selection signal GSEL is output to the selection scanning line 112 that corresponds to the second logic circuit 134*b* at a predetermined timing. The display selection signal GSEL is a signal for selecting a horizontal scanning period for displaying a pixel row corresponding to the selection scanning line 112*b*.

Further, although not shown in FIG. 1, an image signal Data1 for R, an image signal Data2 for G, an image signal Data3 for B are supplied from an image signal processing circuit to the data line driving circuit 150. The data line driving circuit 150 comprises a switching element for R that samples the image signal Data1 for R and supplies the sampled signal to the source line 114 for R, a switching element for G that samples the image signal Data2 for G and supplies the sampled signal to the source line 114 for G, and a switching element for B that samples the image signal Data3 for B and supplies the sampled signal to the source line 114 for B.

Here, the pixel unit 70 arranged to correspond to the source line 114 for R comprises the organic EL element 72 that emits light corresponding to red, and the pixel unit 70 arranged to correspond to the source line 114 for G comprises the organic EL element 72 that emits light corresponding to green. In addition, the pixel unit 70 arranged to correspond to the source line 114 for B comprises the organic EL element 72 that emit light corresponding to blue.

Hereinafter, the image signal Data1 for R, the image signal Data2 for G, and the image signal Data3 for B are simply referred to as image signals DATA. Further, the operation of the scanning line driving circuit 130 and the operation of the data line driving circuit 150 are synchronized with a synchronization signal not shown in FIG. 1.

<2: Operation of Electro-Optical Device>

Figure 5:
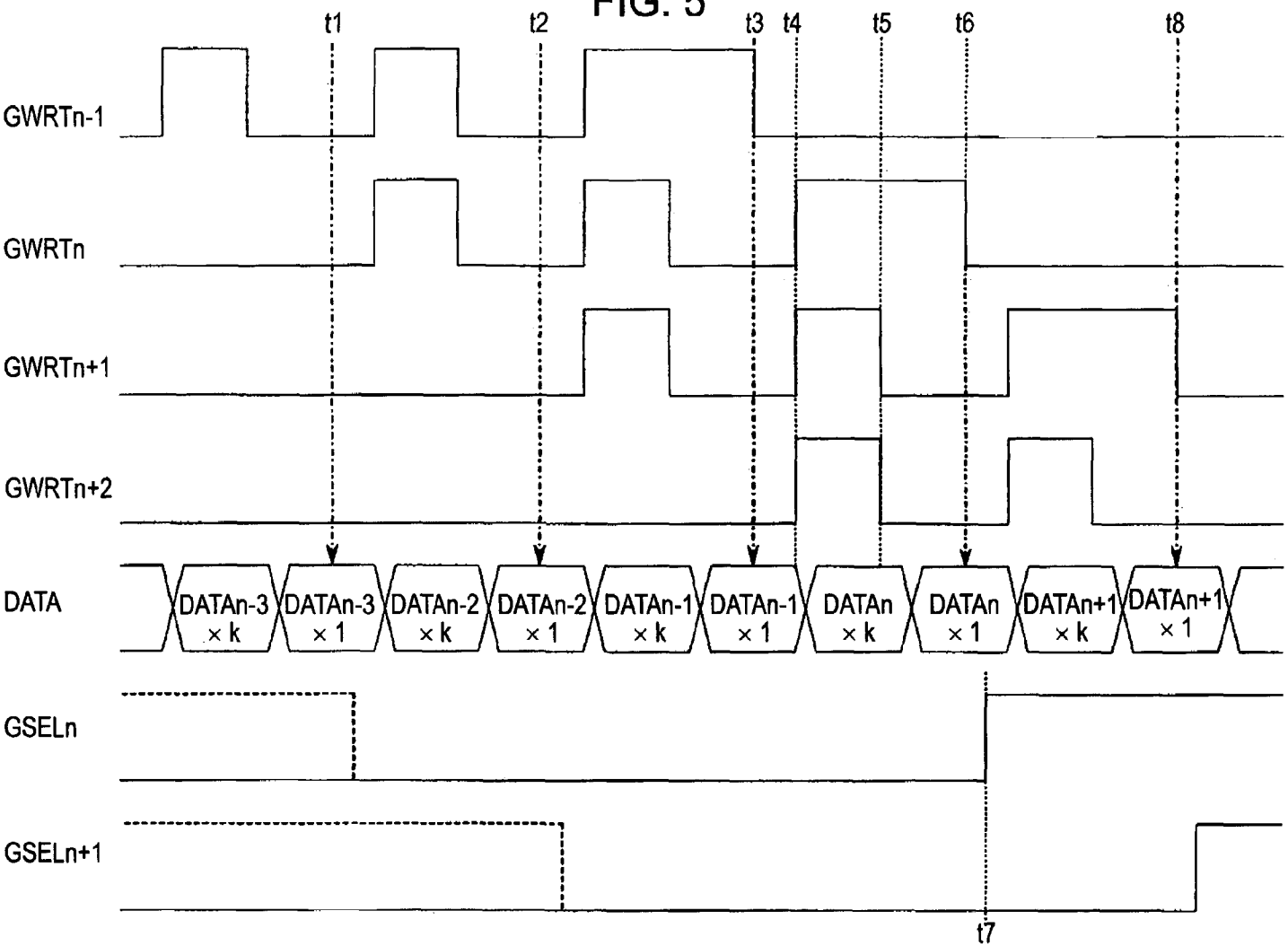
FIG. 5 is a timing chart for illustrating the operation of the electro-optical device.
Figure 6:
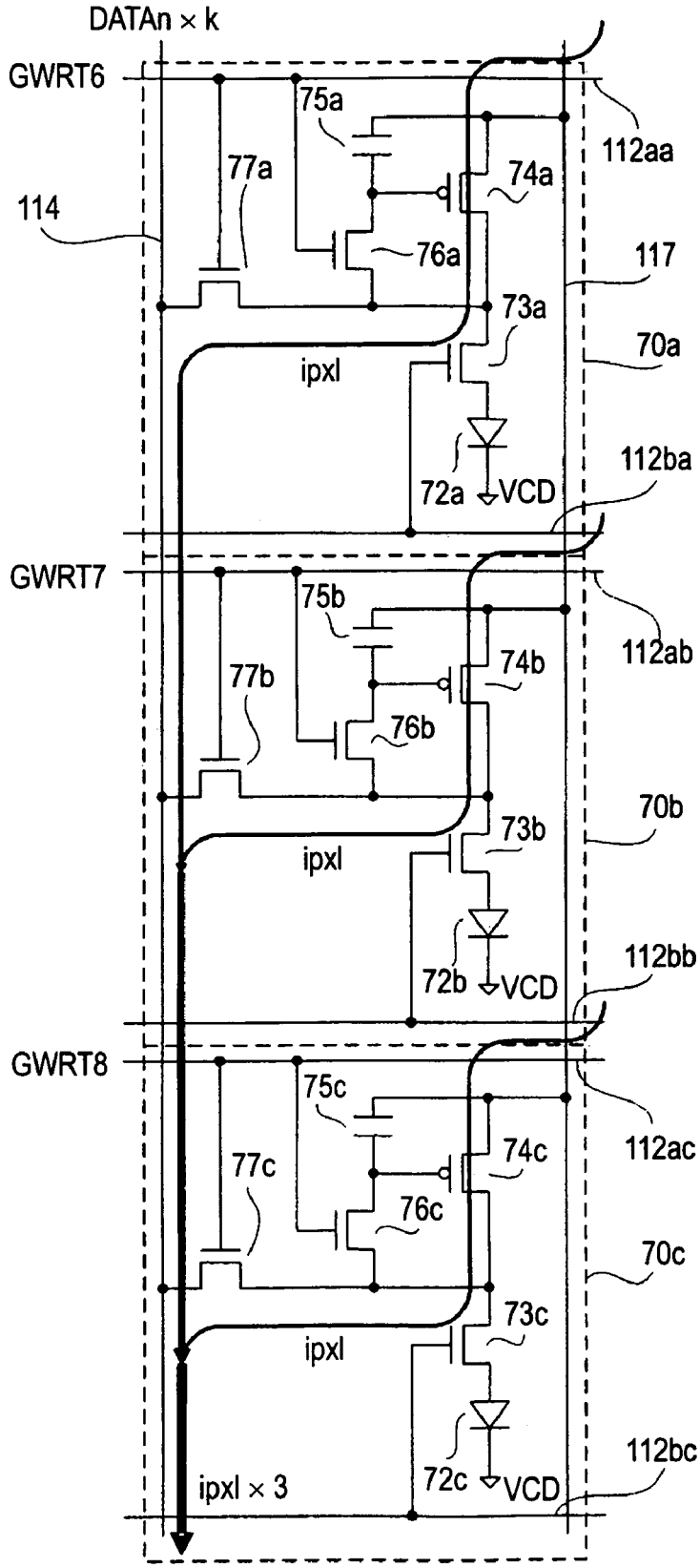
FIG. 6 is a circuit diagram for illustrating an operation for the pixel units in the sixth to eighth rows.
Figure 7:
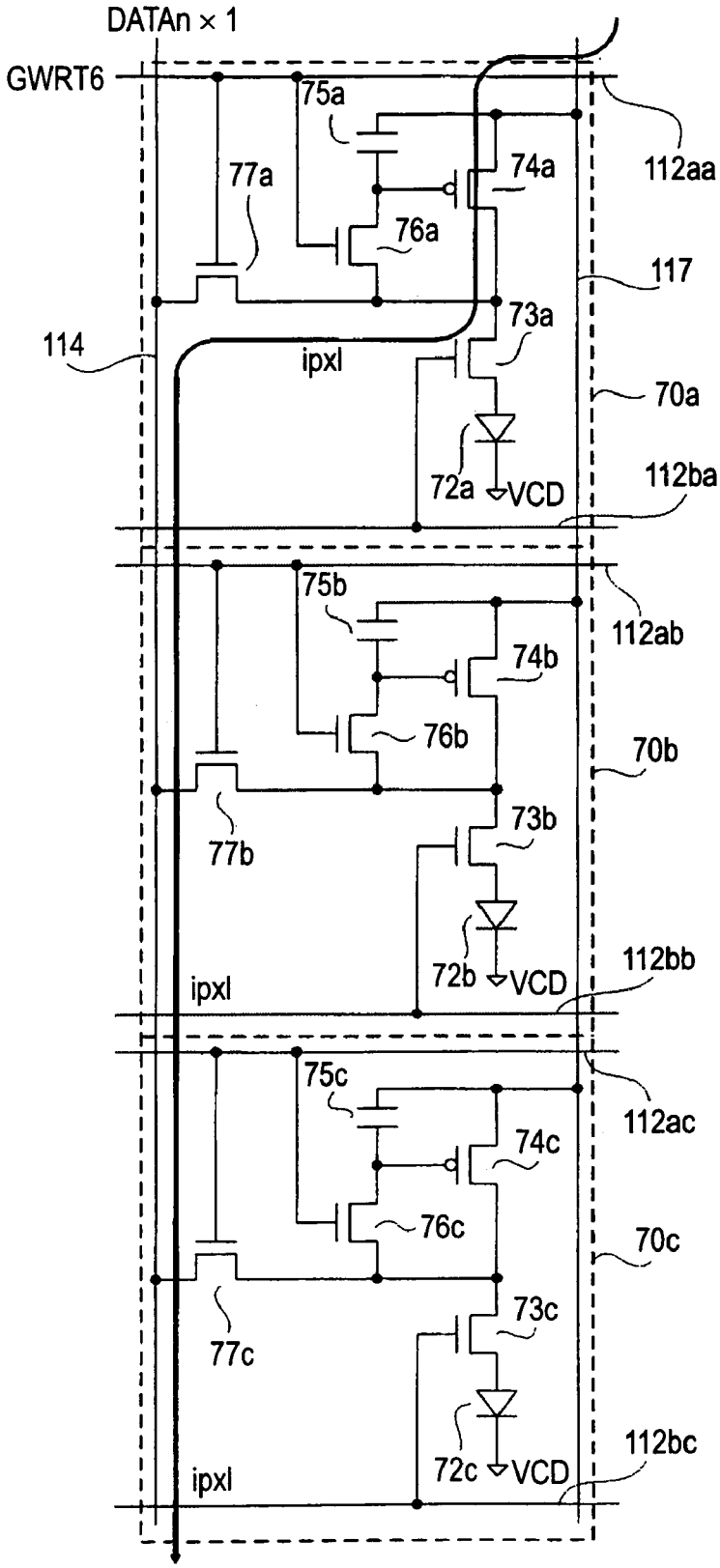
FIG. 7 is a circuit diagram for illustrating another operation for the pixel units in the sixth to eighth rows.
Figure 8:
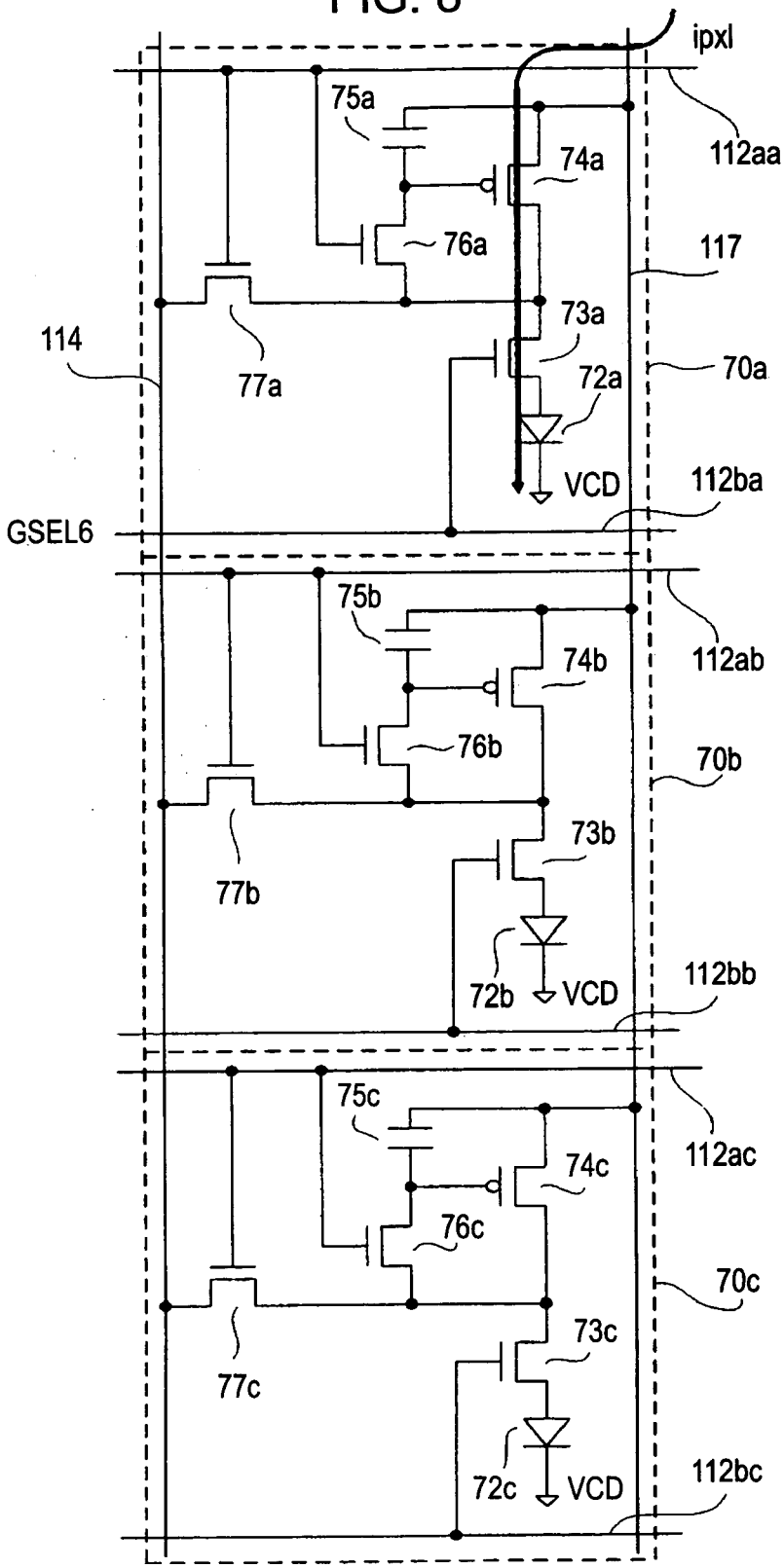
FIG. 8 is a circuit diagram for illustrating yet another operation for the pixel units in the sixth to eighth rows.

Next, the operation of the electro-optical device 1 will be described with reference to FIGS. 3 to 8 along with FIG. 1. FIGS. 3 and 4 are schematic diagrams for illustrating the operation of the electro-optical device 1, respectively, and FIG. 5 is a timing chart for illustrating the operation of the electro-optical device 1. In addition, FIGS. 6 to 8 are circuit diagrams illustrating the operation of the sixth to eighth rows of pixel units 70 arranged to correspond to one source line 114.

The operation of the electro-optical device 1 shown in FIG. 1 is as follows. First, in FIG. 3, as a first operation for display, among the pixel units 70 arranged in a matrix of 10 rows×3 columns in the image display region 110 of the organic EL panel 100, the pixel units 70 in a matrix of 2 rows×3 columns arranged in the first and second rows are turned off, and the pixel units 70 in a matrix of 3 rows×3 columns arranged in the third to fifth rows are turned on. In addition, electric charge is stored, by a current program for the pixel units 70 in the sixth row, in the pixel units 70 in a matrix of 3 rows×3 columns arranged in the sixth to eighth rows, and the pixel units 70 in a matrix of 2 rows×3 columns arranged in the ninth to tenth rows are turned off.

In addition, after the first operation, a second operation as described below is performed. The second operation differs from the first operation shown in FIG. 3 in that, as shown in FIG. 4, the third row of pixel units are turned off while turned on in the first operation, and that the sixth row of pixel units 70 are turned on to perform display, while the current program is completed in the first operation. Therefore, electric charge is stored, by the current program for the seventh row of pixel units 70, in the pixel units 70 in a matrix of 3 rows×3 columns arranged in the seventh to ninth rows.

Next, in the first operation, the operation of the pixel units 70 in a matrix of 3 rows×3 columns arranged in the sixth to eighth rows will now be described in more detail with reference to FIGS. 5 to 7. Hereinafter, the sixth to eighth rows of pixel units 70 along any one of the three source lines 114 are focused.

According to an embodiment of the present invention, the current program is sequentially performed on the respective pixels from the first to tenth rows arranged along one source line 114. In addition, at the time when the current programming is performed on an n-th row of pixel units 70, an (n+1)-th row of pixel units 70 and an (n+2)-th row of pixel units 70 as well as the n-th row of pixel units 70 are selected as k rows of pixel units 70.

The image signal DATA is supplied from the data line driving circuit 150 to one source line 114 in synchronization with the timing when the write selection signal GWRT is output from the scanning line driving circuit 130. More specifically, first electric charge supply is performed by supplying a pseudo data signal from the data line driving circuit 150 as the image signal DATA, and second electric charge supply is performed by supplying a data signal as the image signal DATA.

In the first operation, the current program is performed on a pixel unit 70*a* in the sixth row shown in FIGS. 6 and 7. In FIG. 5, it is assumed that n is 6.

Referring to FIG. 5, a sixth write selection signal GWRTn (n=6) is output from the scanning line driving circuit 130 at the time t4, so that the potential of the sixth write selection signal GWRT6 becomes a high level. Referring to FIG. 6, when the sixth write selection signal GWRT6 becomes a high level, the sixth write selection signal GWRT6 is supplied to the pixel unit 70*a* in the sixth row through the sixth write scanning line 112*aa*. In addition, a period from the time t4 to the time t6 when the sixth write selection signal GWRT6 is at a high level corresponds to the horizontal scanning period for storing electric charge in the pixel unit 70*a* in the sixth row.

Further, at the time t4, in addition to the sixth write selection signal GWRT6, a seventh write selection signal GWRTn+1 (n+1=7) and an eighth write selection signal GWRTn+2 (n+2=8) are also output from the scanning line driving circuit 130, and the potentials of the seventh write selection signal GWRT7 and the eighth write selection signal GWRT8 become high levels at the same time. In FIG. 6, the sixth write selection signal GWRT6 is supplied to the pixel unit 70*a* in the sixth row, and at the same time, the seventh write selection signal GWRT7 is supplied to a pixel unit 70*b* in the seventh row through the seventh write scanning line 112*ab*. In addition, the eighth write selection signal GWRT8 is supplied to a pixel unit 70*c* in the eighth row through the eighth write scanning line 112*ac*.

Here, a period from the time t4 to the time t5 when the seventh write selection signal GWRT7 and the eighth write selection signal GWRT8 become high levels corresponds to the first period of the horizontal scanning period for storing electric charge in the pixel unit 70*a* in the sixth row, and a period from the time t5 to the time t6 corresponds to the second period.

When the sixth write selection signal GWRT6 is supplied to the pixel unit 70*a* in the sixth row, a switching transistor 77*a* and a programming transistor 76*a* are turned on, so that the pixel unit 70*a* in the sixth row is selected. In addition, as in the pixel unit 70*a* in the sixth row, the pixel unit 70*b* in the seventh row and the pixel unit 70*c* in the eighth row are selected simultaneously with the pixel unit 70*a* in the sixth row.

In FIG. 5, at the time t4, the pseudo data signal is supplied to one source line 114 from the data line driving circuit 150. The supply of the pseudo data signal causes a current ipxlx3 corresponding to the amount of electric charge three times larger than that to be supplied to the pixel unit 70*a* in the sixth row to be supplied to the selected three rows through one source line 114. Further, a current ipxl obtained by dividing the current ipxlx3 supplied to the one source line 114 by three pixel units 70*a*, 70*b*, and 70*c* is supplied to the selected pixel units 70*a*, 70*b* and 70*c* in the sixth to eighth rows, respectively.

For the pixel unit 70*a* in the sixth row, when the switching transistor 77*a* and the programming transistor 76*a* are turned on, the pseudo data signal is received from the one source line 114 by the switching transistor 77*a*. In addition, the received pseudo data signal is written to the storage capacitor 75*a* through the programming transistor 76*a*. Depending on the current ipxl in response to the pseudo data signal written to the storage capacitor 75*a*, an electrical conduction state of the diode-connected driving transistor 74*a* is determined.

Further, similar to the pixel unit 70*a* in the sixth row, the pseudo data signals are applied from one source line 114 to the pixel unit 70*b* in the seventh row and the pixel unit 70*c* in the eighth row by means of the switching transistors 77*b* and 77*c*, so that the applied data signals are written to the storage capacitors 75*b* and 75*c*.

Subsequently, referring to FIG. 7, only the pixel unit 70*a* in the sixth row is selected in response to the sixth write selection signal GWRT6 in the second period. Therefore, at the beginning of the second period, for the time t5, the switching transistor 77*b* and the programming transistor 76*b* are turned off in the pixel unit 70*b* in the seventh row. In addition, the pixel unit 70*c* in the eighth row has the same state as that of the pixel unit 70*b* in the seventh row.

In FIG. 5, the data signal is supplied from the data line driving circuit 150 to one source line 114 in the second period. The supply of the data signal causes a current ipxl corresponding to the amount of electric charge to be supplied to the pixel unit 70*a* in the sixth row to be supplied to the one source line 114. Therefore, the data signal is applied from the one source line 114 to the pixel unit 70*a* in the sixth row by means of the switching transistor 77*a*, and the data signal is written to the storage capacitor 75*a* through the programming transistor 76*a*.

Here, in the pixel unit 70*a* in the sixth row, the voltage written to the storage capacitor 75*a* is close to a predetermined voltage programmed into the pixel unit 70*a* in the sixth row. In addition, by writing the data signal to the storage capacitor 75*a*, the predetermined voltage is programmed into the storage capacitor 75*a*.

Next, when the second period is over at the time t6, the switching transistor 77*a* and the programming transistor 76*a* in the pixel unit 70*a* in the sixth row are turned off. Then, the first operation is completed.

Subsequently, referring to FIGS. 5 and 8, a second operation of the pixel units 70 in the sixth to eighth rows arranged along one source line 114 will be described.

In the present embodiment, the current program is sequentially performed on the respective pixel units in the first to tenth rows arranged along one source line 114 such that the respective pixel units are sequentially turned on.

Here, in the period from the time t4 to the time t6 as shown in FIG. 5, the lighting transistors 73*a*, 73*b*, and 73*c* are turned off in the pixel units 70*a*, 70*b*, and 70*c* in the sixth to eighth rows, respectively. At the time t7, the sixth display selection signal GSELn (n=6) is output from the scanning line driving circuit 130, and the potential of the sixth display selection signal GSEL6 becomes a high level. Referring to FIG. 8, when the sixth display selection signal GSEL6 becomes a high level, the sixth display selection signal GSEL6 is supplied to the pixel unit 70*a* in the sixth row through the sixth selection scanning line 112*ba*. At this time, the period when the sixth display selection signal GSEL6 is a high level corresponds to a horizontal scanning period for displaying the pixel unit 70*a* in the sixth row.

In the pixel unit 70*a* in the sixth row, when the sixth display selection signal GWRT6 is supplied, the lighting transistor 73*a* is turned on, and a current ipxl corresponding to the predetermined voltage written to the storage capacitor 75*a* is supplied from the current supply line 117 to the organic EL element 72*a* through the driving transistor 74*a* and the lighting transistor 73*a*. The organic EL element 72*a* is turned on in response to the supplied current ipxl.

Further, in the second operation, after the time t7, the current program is performed on the pixel unit 70*b* in the seventh row in the same manner as the pixel unit 70*a* in the sixth row. In addition, as in the pixel unit 70*a* in the sixth row, the current program is performed on the pixel units 70 in the fifth, fourth, and third rows. Therefore, at the times t1, t2, t3, and t8, the data signal supply is performed by the data line driving circuit 150 as shown in FIG. 5.

Therefore, according to the electro-optical device 1 of the present embodiment, it is possible to program a predetermined voltage into the n-th row of pixel units 70 in a shorter time, compared to in a case where electric charge is supplied by selecting only the n-th row of pixel units 70 for the horizontal scanning period for storing electric charge. In particular, even when the wiring capacitance of the source line 114 and the current supply line 117 is large enough not to be negligible, it is possible to charge the source line 114 and the current supply line 117 with k times the amount of electric charge in the first period as described above, and to write the electric charge to each pixel unit 70 through the source line 114 and the current supply line 117 in a short time within the second period. In addition, in the second period next to the first period, the predetermined voltage is programmed into the n-th row of pixel units 70. Therefore, even when any one of three rows of pixel units 70 has a defect, the programming can be performed on the n-th row of pixel units 70 almost without being affected by the defect. Moreover, it is possible to increase the current value of the source line 114 at the time of current programming, without increasing the circuit size of each pixel unit 70. Further, the execution of the current program enables the electro-optical device 1 to perform high-quality image display by preventing the generation of a flicker.

In addition, after the second period, the horizontal scanning period for displaying the n-th row of pixel units is selected, so that it is possible to prevent display in response to the pseudo data signal by means of the n-th row of pixel units 70.

Furthermore, according to the present embodiment, at the time of current programming, three rows of pixel units 70 are selected, and the three rows of pixel units 70 are sequentially turned off, thereby reducing a duty ratio and obtaining the driving current of the electro-optical panel.

<3: Electronic Apparatus>

A case in which the above-mentioned electro-optical device 1 is applied to various electronic apparatuses is described below.

<3-1: Mobile Computer>

Figure 9:
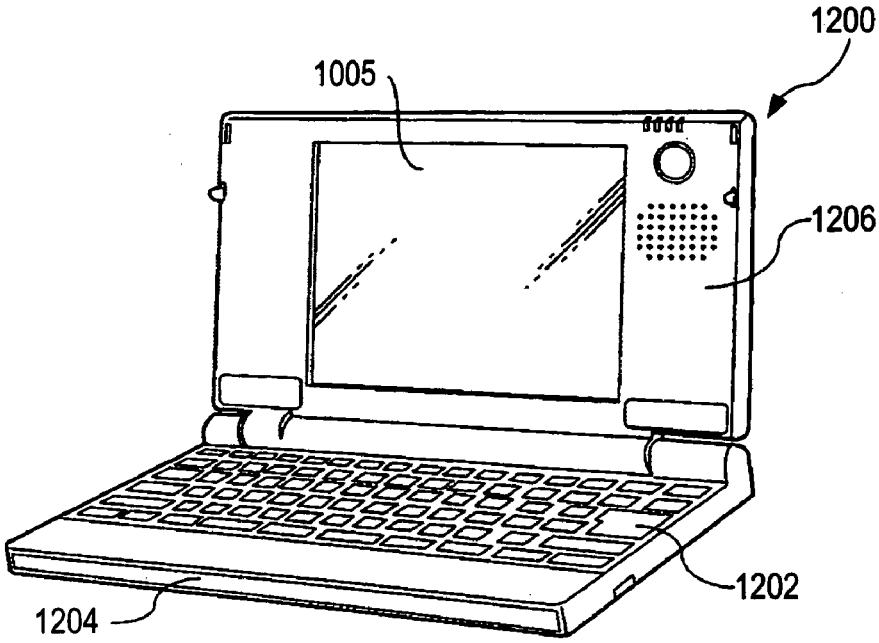
FIG. 9 is a perspective view showing a configuration of a person computer as an example of an electronic apparatus to which the electro-optical device of the present invention is applied.

First, an example in which the electro-optical device is applied to a mobile personal computer is described. FIG. 9 is a perspective view showing a configuration of the personal computer. In FIG. 9, a computer 1200 comprises a main body 1204 having a keyboard 1202 and a display unit 1206 having the electro-optical device.

<3-2: Mobile Phone>

Figure 10:
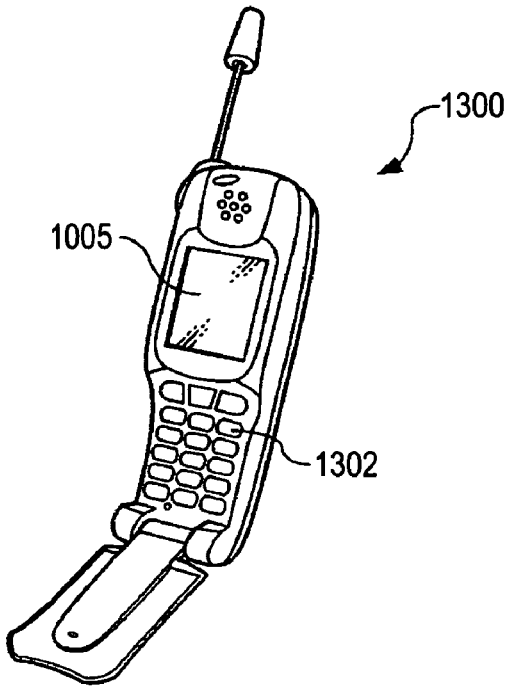
FIG. 10 is a perspective view showing a configuration of a mobile phone as an example of an electronic apparatus to which the electro-optical device of the present invention is applied.

Further, an example in which the electro-optical device is applied to a mobile phone. FIG. 10 is a perspective view showing a configuration of a mobile phone. Referring to FIG. 10, a mobile phone 1300 comprises a plurality of operating buttons 1302, and an electro-optical device having an organic EL panel. In FIG. 10, the organic EL panel is indicated by reference numeral "1005".

In addition, the electro-optical device can be applied to electronic apparatuses, such as notebook-type personal computers, PDAs, TV sets, viewfinder type or monitor-direct-view type videotape recorders, car navigation devices, pagers, electronic organizers, word processors, workstations, POS terminals, apparatuses equipped with touch panels, and the like.

While the present invention has been described with reference to exemplary embodiments thereof, it will be understood by those skilled in the art that various changes in form and details may be made therein without departing from the scope of the present invention as defined by the following claims, so that a device and a method for driving an electro-optical panel, an electro-optical device having the electro-optical panel and the driving device thereof, and various electronic apparatuses having the electro-optical device are also included in the scope of the present invention.

What is claimed is:

1. A device for driving an active matrix electro-optical panel in which a plurality of pixels in an image display region each have an electro-optical element and active element means for actively controlling the electro-optical element to selectively supply electric charge to the electro-optical element through a source line in response to a write selection signal that selects a horizontal scanning period for storing the electric charge in each row of pixel units, the driving device comprising:

first driving circuit for, in a first period of the horizontal scanning period for storing the electric charge in an n-th row of pixel units (where, n is a natural number), simultaneously supplying the write selection signal to k rows of pixel units (where, k is a natural number greater than or equal to 2) including the n-th row of pixel units through write scanning lines arranged to correspond to the respective rows of the pixel units, and for supplying the write selection signal to the n-th row of pixel units in a second period of the horizontal scanning period for storing the electric charge; and second driving circuit for simultaneously performing first electric charge supply on the k rows of pixel units arranged along any one of the source lines through the one source line in the first period, and for performing second electric charge supply on the n-th row of pixel units through the one source line in the second period, wherein after the second period, the second electric charge is stored in the n-th row of pixel units and the first electric charge is stored in the k rows of pixel units other than the n-th row of pixel units.

2. The device for driving an electro-optical panel according to claim 1, wherein, after the second period, the active element means supplies the electric charge to the electro-optical element belonging to the n-th row of pixel units according to the second electric charge supply in response to a display selection signal that selects the horizontal scanning period for displaying each row of pixel units, after the second period, the first driving circuit supplies the display selection signal to the n-th row of pixel units through a selection scanning line arranged to correspond to each row of pixel units, and wherein the second driving circuit performs pseudo data signal supply as the first electric charge supply in the first period and performs the data signal supply to the n-th row of pixel units as the second electric charge supply in the second period.

3. The device for driving an electro-optical panel according to claim 2, wherein, after the horizontal scanning period for storing the electric charge in the k rows of pixel units is over, the first driving circuit supplies the display selection signal to the n-th row of pixel units included in the k rows of pixel units to select the horizontal scanning period for display.

4. The device for driving an electro-optical panel according to claim 2, the active element means further comprising:

one or more first active elements for starting the first and second electric charge supplies in response to the write selection signal; and one or more second active elements for supplying the electric charge to the electro-optical element belonging to the n-th row of pixel units according to the second electric charge supply in response to the display selection signal.

5. The device for driving an electro-optical panel according to claim 1, the plurality of pixels each further comprise a storage capacitor for storing the electric charge supplied by the second charge supply so as to define the amount of electric charge applied to the electro-optical element through some of the active element means, and wherein, in the first and second periods, the second driving circuit performs the first and second electric charge supplies on the source lines and the storage capacitors, respectively.

6. The device for driving an electro-optical panel according to claim 5, wherein, in the second period, the second driving circuit performs the second electric charge supply on the source lines and the storage capacitors to write a voltage corresponding to the data signal with respect to the n-th row of pixel units to the storage capacitor.

7. The device for driving an electro-optical panel according to claim 1, wherein the k rows of pixel units include the n-th row of pixel units, an (n+1)-th row of pixel units, and an (n+2)-th row of pixel units.

8. An electro-optical device comprising the device for driving an electro-optical panel and the electro-optical panel according to claim 1.

9. An electronic apparatus comprising the electro-optical device according to claim 8.

10. A method of driving an active matrix electro-optical panel in which a plurality of pixels in an image display region each have an electro-optical element and active element means for actively controlling the electro-optical element to selectively supply electric charge to the electro-optical element through a source line in response to a write selection signal that selects a horizontal scanning period for storing the electric charge in each row of pixel units, the method comprising:

a first driving step of, in a first period of the horizontal scanning period for storing the electric charge in an n-th row of pixel units (where, n is a natural number), simultaneously supplying the write selection signal to k rows of pixel units (where, k is a natural number greater than or equal to 2) including the n-th row of pixel units through write scanning lines arranged to correspond to the respective rows of the pixel units, and of supplying the write selection signal to the n-th row of pixel units in a second period of the horizontal scanning period for storing the electric charge; and a second driving step of simultaneously performing first electric charge supply on the k rows of pixel units arranged along any one of the source lines through the one source line in the first period, and of performing second electric charge supply on the n-th row of pixel units through the one source line in the second period, wherein after the second period, the second electric charge is stored in the n-th row of pixel units and the first electric charge is stored in the k rows of pixel units other than the n-th row of pixel units.

* * * * *